US010225642B2

(12) United States Patent
Song

(10) Patent No.: US 10,225,642 B2
(45) Date of Patent: Mar. 5, 2019

(54) EARSET AND EARSET OPERATION METHOD

(71) Applicant: Samsung Electronics Co., Ltd., Gyeonggi-do (KR)

(72) Inventor: Min-Woo Song, Gyeongsangbuk-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 15/328,230

(22) PCT Filed: Dec. 17, 2014

(86) PCT No.: PCT/KR2014/012482

§ 371 (c)(1),
(2) Date: Jan. 23, 2017

(87) PCT Pub. No.: WO2016/013733

PCT Pub. Date: Jan. 28, 2016

(65) Prior Publication Data

US 2017/0230747 A1 Aug. 10, 2017

(30) Foreign Application Priority Data

Dec. 17, 2014 (KR) ..... 10-2014-0093352

(51) Int. Cl.
*H04R 1/10* (2006.01)

(52) U.S. Cl.
CPC ..... *H04R 1/1083* (2013.01); *H04R 1/1041* (2013.01); *H04R 2420/03* (2013.01); *H04R 2420/05* (2013.01)

(58) Field of Classification Search
CPC .. H04R 1/1041; H04R 5/04; H04R 2201/107; H04R 2420/03
See application file for complete search history.

(56) References Cited

U.S. PATENT DOCUMENTS

2001/0050991 A1 12/2001 Eves
2008/0175399 A1 7/2008 Kim et al.
(Continued)

FOREIGN PATENT DOCUMENTS

CN 101340736 1/2009
CN 101453510 6/2009
(Continued)

OTHER PUBLICATIONS

PCT/ISA/210 Search Report issued on PCT/KR2014/012482 (pp. 3).
(Continued)

*Primary Examiner* — Duc Nguyen
*Assistant Examiner* — Kile Blair
(74) *Attorney, Agent, or Firm* — The Farrell Law Firm, P.C.

(57) ABSTRACT

An earset, according to various examples, comprises: an electronic device connection unit having a microphone terminal connected to a microphone of the earset, an audio ground terminal connected to an audio ground of the earset, a right speaker terminal, and a left speaker terminal; and a switch for allowing, according to a voltage of the microphone terminal, a right speaker and a left speaker of the earset to be mutually connected with one of the right speaker terminal and the left speaker terminal, and the other one of the right speaker terminal and the left speaker terminal to be connected with a shield ground of the earset. Other examples are possible.

18 Claims, 11 Drawing Sheets

(56) References Cited

U.S. PATENT DOCUMENTS

| | | | |
|---|---|---|---|
| 2009/0316931 | A1 | 12/2009 | Dal et al. |
| 2011/0216912 | A1 | 9/2011 | Seo |

FOREIGN PATENT DOCUMENTS

| | | |
|---|---|---|
| CN | 102685639 | 9/2012 |
| CN | 102769810 | 11/2012 |
| CN | 103379401 | 10/2013 |
| CN | 103414984 | 11/2013 |
| CN | 203466965 | 3/2014 |
| EP | 0 999 721 | 5/2000 |
| EP | 2 285 134 | 2/2011 |
| EP | 2 728 899 | 5/2014 |
| JP | 07-231293 | 8/1995 |
| JP | 2008048115 | 2/2008 |
| KR | 1020070080011 | 8/2007 |
| KR | 1020070091926 | 9/2007 |
| KR | 100892095 | 3/2009 |
| KR | 1020090041000 | 4/2009 |
| KR | 1020110100728 | 9/2011 |
| KR | 1020120122017 | 11/2012 |
| KR | 102013017441 | 2/2013 |
| KR | 101315216 | 9/2013 |

OTHER PUBLICATIONS

European Search Report dated Feb. 7, 2018 issued in counterpart application No. 14897915.6-1210, 5 pages.
Chinese Office Action dated Aug. 1, 2018 issued in counterpart application No. 201480080811.5, 17 pages.

EARSET AND EARSET OPERATION METHOD

PRIORITY

This application is a National Phase Entry of PCT International Application No. PCT/KR2014/012482, which was filed on Dec. 17, 2014, and claims priority to Korean Patent Application No. 10-2014-0093352, which was filed on Jul. 23, 2014, the contents of each of which are incorporated herein by reference.

TECHNICAL FIELD

Various embodiments of the present invention relate to an earset and method for operating an earset to remove noise created during a phone call through an earset provided in an electronic device.

BACKGROUND ART

Recently under development is technology for delivering clear, noise-free sounds to users when they perform a phone call through an electronic device, e.g., a smartphone. For example, noise suppressor techniques using two microphones—so called 2MIC Noise Suppressor—have been developed. As per the 2MIC Noise Suppressor technology, there is implemented a circuit in which two microphones are mounted in an electronic device to cancel noise during a phone call in a handset mode, providing the opposite party of the phone call with noise-free voices.

Meanwhile, headphones, headsets, ear microphones, or other earsets provide the users of electronic devices with such convenience as, e.g., partially blocking external noise and/or preventing delivery of unnecessary sounds to ambient people. The users of the electronic devices oftentimes connect such earsets to the electronic devices in various situations, such as when they are driving or walking, to listen to music or make a phone call.

Earsets generally used nationwide or worldwide are ones with a four-pole standard circuit (also called four-pole earsets). A four-pole earset have signal lines respectively assigned for a microphone, a left-hand speaker, a right-hand speaker, and a ground, wherein the ground is implemented in a shielding structure allowing the same to be used as both an audio ground and shielding ground.

DETAILED DESCRIPTION OF THE INVENTION

Technical Problem

Conventional earsets commonly used have a four-pole standard circuit. The ground of a four-pole standard circuit-applied earset is manufactured as a single one, i.e., an audio ground-cum-shielding ground, and is formed to surround the microphone, left-hand speaker, and right-hand speaker as shown in FIG. 11. Therefore, as the earset is brought close to the antenna, RF (TDMA) noise is created in the ground surrounding the left-hand and right-hand speaker and microphone. Since the ground plays a role as both an audio ground and shielding ground, the RF noise may, as it is, flow in the electronic device connected with the earset.

Such a technique as to attenuate ambient noise for an easier phone call when the electronic device is in a handset mode has conventionally been developed, but not a technique for attenuating ambient noise when the user of the electronic device uses the earset to make a phone call (i.e., when the electronic device is in an earset mode).

Further, the user of an electronic device commonly uses an earset for a phone call while he or she is driving or walking in which case the user is bothered with surrounding noise.

Thus, according to various embodiments of the present invention, there are provided an earset and method for operating an earset to remove noise created during a phone call through an earset provided in an electronic device.

Technical Solution

According to an aspect of the present invention, an earset may comprise an electronic device connector including a microphone terminal connecting with a microphone of the earset, an audio ground terminal connecting with an audio ground of the earset, a right-hand speaker terminal, and a left-hand speaker terminal and a switch allowing a right-hand speaker and a left-hand speaker of the earset to jointly connect with one of the right-hand speaker terminal and the left-hand speaker terminal and the other one of the right-hand speaker terminal and the left-hand speaker terminal to connect with a shielding ground of the earset, as per a voltage at the microphone terminal.

According to another aspect of the present invention, an earset may comprise an electronic device connector including a first microphone terminal connecting with a first microphone of the earset, an audio ground terminal connecting with an audio ground of the earset, a right-hand speaker terminal, and a left-hand speaker terminal and a switch allowing a right-hand speaker and a left-hand speaker of the earset to jointly connect with one of the right-hand speaker terminal and the left-hand speaker terminal and the other one of the right-hand speaker terminal and the left-hand speaker terminal to connect with a second microphone of the earset, as per a voltage at the first microphone terminal.

According to still another aspect of the present invention, a method for operating an earset having a microphone terminal, an audio ground terminal, a right-hand speaker terminal, and a left-hand speaker terminal, may comprise an operation allowing the earset to receive power from an electronic device if the earset and the electronic device connect together and a switching operation in which a switch of the earset allows a right-hand speaker and a left-hand speaker of the earset to jointly connect with one of the right-hand speaker terminal and the left-hand speaker terminal and the other one of the right-hand speaker terminal and the left-hand speaker terminal to connect with a shielding ground of the earset, as per a voltage of the received power.

According to yet still another aspect of the present invention, a method for operating an earset having a microphone terminal, an audio ground terminal, a right-hand speaker terminal, and a left-hand speaker terminal, may comprise an operation allowing the earset to receive power from an electronic device if the earset and the electronic device connect together and a switching operation in which a switch of the earset allows a right-hand speaker and a left-hand speaker of the earset to jointly connect with one of the right-hand speaker terminal and the left-hand speaker terminal and the other one of the right-hand speaker terminal and the left-hand speaker terminal to connect with a second microphone of the earset, as per a voltage of the received power.

Advantageous Effects

According to various embodiments of the present invention, an earset and method for operating the earset may implement a device for separating an audio ground and shielding ground of the earset while maintaining the four-pole standard of the earset. Accordingly, noise generated during a phone call using the earset connected with the electronic device may be removed.

Further, according to various embodiments of the present invention, the earset and method for operating the earset enables two microphones to be attached to the earphone while maintaining the four-pole standard of the earset, allowing the conventional 2MIC noise suppressor technique to be implemented also in the earphone. Accordingly, noise generated during a phone call using the earset connected with the electronic device may be removed.

MODE FOR CARRYING OUT THE INVENTION

Figure 1:
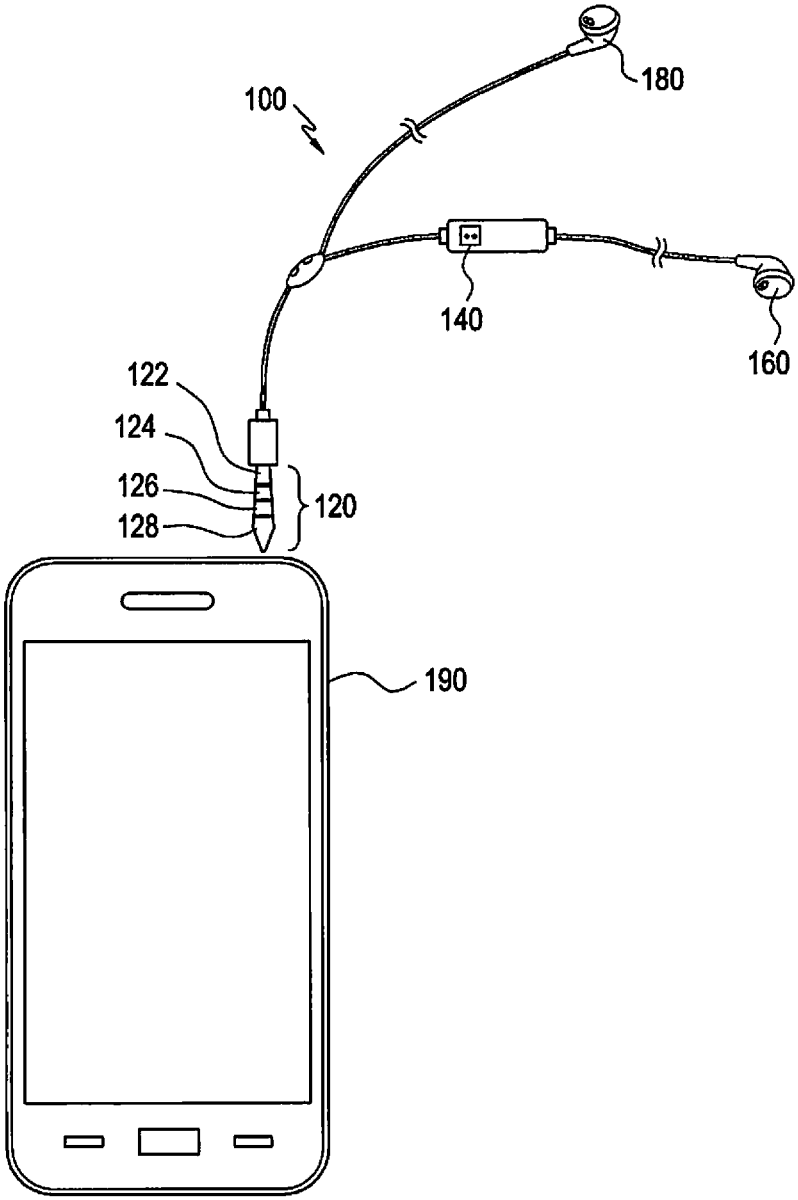
FIG. 1 is a view illustrating an outer look of an earset inserted into an electronic device according to an embodiment of the present invention.

Hereinafter, embodiments of the present invention are described with reference to the accompanying drawings. Various changes may be made to the present invention, and the present invention may come with a diversity of embodiments. Some embodiments of the present invention are shown and described in connection with the drawings. However, it should be appreciated that the present invention is not limited to the embodiments, and all changes and/or equivalents or replacements thereto also belong to the scope of the present invention. The same or similar reference denotations are used to refer to the same or similar elements throughout the specification and the drawings.

The terms "comprise" and/or "comprising" as herein used specify the presence of disclosed functions, operations, or components, but do not preclude the presence or addition of one or more other functions, operations, or components. It will be further understood that the terms "comprise" and/or "have," when used in this specification, specify the presence of stated features, integers, steps, operations, elements, and/or components, but do not preclude the presence or addition of one or more other features, integers, steps, operations, elements, components, and/or groups thereof.

As used herein, the term "A or B" or "at least one of A and/or B" includes any and all combinations of one or more of the associated listed items. For examples, "A or B" or "at least one of A or/and B" each may include A, or include B, or include both A and B.

Ordinal numbers as herein used, such as "first", "second", etc., may modify various components of various embodiments, but do not limit those components. For example, these terms do not limit the order and/or importance of the components. These terms are only used to distinguish one component from another. For example, a first user device and a second user device are different user devices from each other. For example, a first component may be denoted a second component, and vice versa without departing from the scope of the present invention.

When a component is "connected to" or "coupled to" another component, the component may be directly connected or coupled to the other component, or other component(s) may intervene therebetween. In contrast, when a component is "directly connected to" or "directly coupled to" another component, no other intervening components may intervene therebetween.

The terms as used herein are provided merely to describe some embodiments thereof, but not to limit the present invention. It is to be understood that the singular forms "a," "an," and "the" include plural references unless the context clearly dictates otherwise.

Unless otherwise defined, all terms including technical and scientific terms used herein have the same meaning as commonly understood by one of ordinary skill in the art to which the embodiments of the present invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

According to various embodiments of the present invention, an electronic device as disclosed herein may be a device with a communication function. For example, examples of the electronic device may include, but is not limited to, a smartphone, a tablet PC, a mobile phone, a video phone, an e-book reader, a desktop PC (personal computer), a laptop computer, a netbook computer, a PDA (personal digital assistant), a PMP (portable multimedia player), an MP3 player, a mobile medical device, a camera, or a wearable device (e.g., a head-mounted device (HMD), electronic clothes, an electronic bracelet, an electronic necklace, an electronic appcessory, an electronic tattoo, or a smart watch).

According to an embodiment of the present invention, the electronic device may be a smart home appliance with a communication function. For example, examples of the smart home appliance may include, but is not limited to, a television, a digital video disk (DVD) player, an audio player, a refrigerator, an air conditioner, a vacuum cleaner, an oven, a microwave oven, a washer, a drier, an air cleaner, a set-top box, a TV box (e.g., Samsung HomeSync™, Apple TV™, or Google TV™), a gaming console, an electronic dictionary, a camcorder, or an electronic picture frame.

According to an embodiment of the present invention, examples of the electronic device may include, but is not limited to, various medical devices (e.g., magnetic resource angiography (MRA) device, a magnetic resource imaging (MRI) device, a computed tomography (CT) device, an imaging device, or an ultrasonic device), a navigation device, a global positioning system (GPS) receiver, an event data recorder (EDR), a flight data recorder (FDR), an automotive infotainment device, an sailing electronic device (e.g., a sailing navigation device, a gyroscope, or a compass), avionics, security devices, vehicular head units, industrial or home robots, automatic teller's machines (ATMs), or point of sales (POS) devices.

According to various embodiments of the invention, examples of the electronic device may include, but is not limited to, a piece of furniture or part of a building/structure having a communication function, an electronic board, an electronic signature receiving device, a projector, or various measurement devices (e.g., devices for measuring water, electricity, gas, or electromagnetic waves).

According to an embodiment of the present invention, the electronic device may be one or a combination of the above-listed devices or appliances. According to an embodiment of the present invention, the electronic device may be a flexible device. According to an embodiment of the present invention, the electronic device is not limited to the above-listed devices or appliances.

As used herein, the term "user" may denote a human or another device using the electronic device.

FIG. 1 is a view illustrating an outer look of an earset inserted into an electronic device according to an embodiment of the present invention. Referring to FIG. 1, the earset 100 may include an electronic device connector 120, a microphone 140, a right-hand speaker 160, and a left-hand speaker 180. Further, the earset 100 may further include volume-up and volume-down buttons (not shown) for adjusting the volume of the electronic device.

The electronic device connector 120, one plugged into an ear jack (not shown) of the electronic device 190, may connect the earset 100 with the electronic device 190. Further, the electronic device connector 120 may include a microphone terminal 122, an audio ground terminal 124, a right-hand speaker terminal 126, and a left-hand speaker terminal 128.

Figure 2:
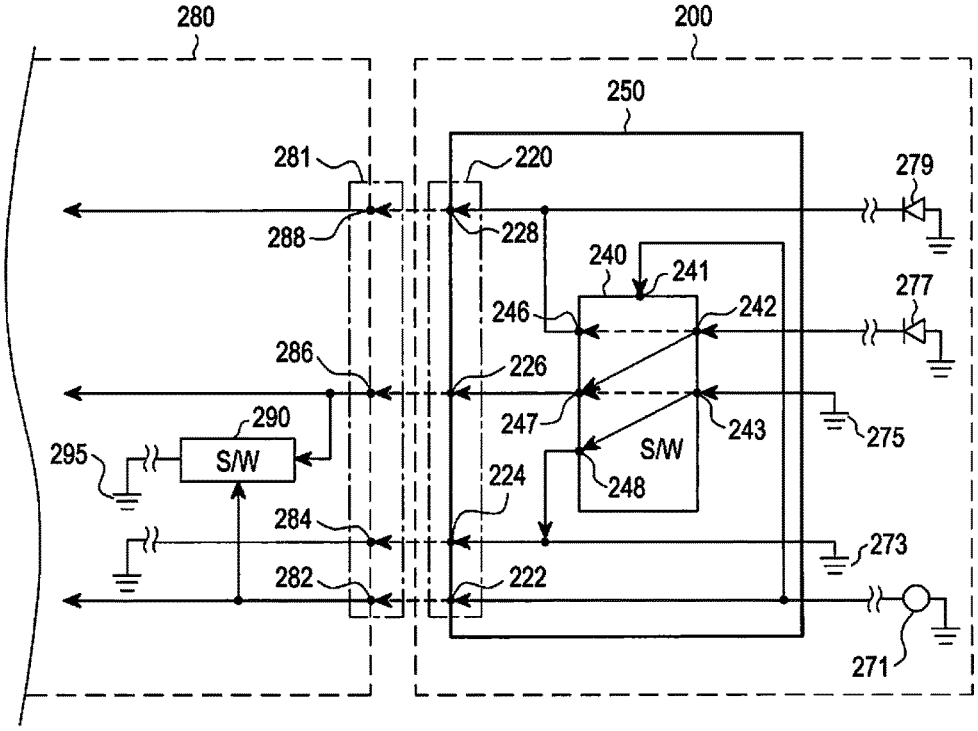
FIG. 2 is a circuit diagram illustrating an earset according to a first embodiment of the present invention.

FIG. 2 is a circuit diagram illustrating an earset according to a first embodiment of the present invention. Referring to FIG. 2, an earset 200 includes a switch 240. According to a voltage inputted to a microphone terminal 222, the switch 240 performs a switching operation allowing a right-hand speaker 277 and a left-hand speaker 279 of the earset 200 to be jointly connected with one of a right-hand speaker terminal 226 and a left-hand speaker terminal 228 or the other of the right-hand speaker terminal 226 and the left-hand speaker terminal 228 to be connected with a shielding ground 275, so that a typical earset having an audio ground-cum-shielding ground may be operated as one in which the audio ground and the shielding ground have been separated from each other.

For example, if the voltage at the microphone terminal 222 is not smaller than a designated reference voltage, the switch 240 performs a switching operation allowing the right-hand speaker 277 to connect with the left-hand speaker terminal 228 and the shielding ground 275 to connect with the right-hand speaker terminal 226, so that the audio ground 273 and shielding ground 275 of the earset 200 may be implemented separately.

Further, if the voltage at the microphone terminal 222 is smaller than the designated reference voltage, the switch 240 performs a switching operation allowing the right-hand speaker 277 to connect with the right-hand speaker terminal 226 and the shielding ground 275 to connect with the audio ground terminal 224, so that the audio ground 275 and shielding ground 273 of the earset 200 may be implemented for both the purposes as in conventional earsets.

Meanwhile, the left-hand speaker 279, the audio ground 273, and the microphone 271 respectively connect with the left-hand speaker terminal 228, the audio ground terminal 224, and the microphone terminal 222 as in conventional earsets.

An earset device 250 of the earset 200 may include an electronic device connector 220 and the switch 240.

The electronic device connector 220 may include a microphone terminal 222, an audio ground terminal 224, a right-hand speaker terminal 226, and a left-hand speaker terminal 228 of an earset having a typical structure.

The switch 240 may include a power input terminal 241, a first signal input terminal 242, a second signal input terminal 243, a first signal output terminal 246, a second signal output terminal 247, and a third signal output terminal 248. The switch 240 may be an analog switch.

As in an earset having a typical structure, the microphone terminal 222, the audio ground terminal 224, and the left-hand speaker terminal 228 may be configured to connect a first microphone 271, an audio ground 273, and a left-hand speaker 279, respectively, via signal lines.

According to an embodiment of the present invention, as per a switching operation of the switch 240, the right-hand speaker terminal 226 may be configured to connect with the right-hand speaker 277 or the shielding ground 275. Further, as per a switching operation of the switch 240, the left-hand speaker terminal 228 may be configured to further connect or not with the right-hand speaker 277, and the audio ground terminal 224 may be configured to further connect or not with the shielding ground 275.

Connections among the above-described components are described below in greater detail.

The microphone terminal 222 may be configured to connect with the power input terminal 241 of the switch 240 and the microphone 271 of the earset 200 via signal lines. Further, the audio ground terminal 224 may be configured to connect with the third signal output terminal 248 of the switch 240 and the audio ground 273 via signal lines. Further, the right-hand speaker terminal 226 may be configured to connect with the second signal output terminal 247 of the switch 240 via a signal line. Further, the left-hand speaker terminal 228 may be configured to connect with the first signal output terminal 246 of the switch 240 and the left-hand speaker 279 of the earset 200 via signal lines.

The power input terminal 241 of the switch 240 may be configured to connect, via a signal line, with the signal line connecting the microphone terminal 222 with the microphone 271, and the first signal input terminal 242 may be configured to connect with the right-hand speaker 277 of the earset 200 via a signal line, and the second signal input terminal 243 may be configured to connect with the shielding ground 275 of the earset 200 via a signal line.

Further, the switch 240 may receive power through the power input terminal 241. The switch 240 may, as per an input voltage at the power input terminal 241 (as per a voltage at the microphone terminal 222), switch to connect the first signal input terminal 242 of the switch 240 with the first signal output terminal 246 or the second signal output terminal 247 and to connect the second signal input terminal 243 of the switch 240 with the second signal output terminal 247 or the third signal output terminal 248.

For example, if the voltage at the power input terminal 241 (the microphone terminal 222) is smaller than a designated reference voltage, the switch 240 may switch to connect the first signal input terminal 242 with the second signal output terminal 247 and to connect the second signal input terminal 243 with the third signal output terminal 248.

Further, for example, if the voltage at the power input terminal 241 (the microphone terminal 222) is not smaller than the designated reference voltage, the switch 240 may switch to connect the first signal input terminal 242 with the first signal output terminal 246 and to connect the second signal input terminal 223 with the second signal output terminal 247.

Meanwhile, the electronic device 280 may include an ear jack 281 of a typical structure. The ear jack 281 may include a microphone terminal 282, an audio ground terminal 284, a right-hand audio terminal 286, and a left-hand audio terminal 288. Further, the microphone terminal 282, the audio ground terminal 284, the right-hand audio terminal 286, and the left-hand audio terminal 288 are configured to typically connect with a codec (not shown) of the electronic device 280 via signal lines.

A typical structure of the electronic device 280 into which the earset 200 is plugged is described below in detail.

The microphone terminal 282 may be configured to connect with a power supply (not shown) of the electronic device 280 to supply power to the earset 200 and may receive a microphone signal from the microphone 271 of the earset 200. The right-hand audio terminal 286 may output a right-hand audio signal from the electronic device 280 to the earset 200. Further, the right-hand audio terminal 286 may connect or not with a main ground 295 of the electronic device 280 as per a switching operation of a switch 290 of the electronic device 280. The switch 290 may connect in series between the right-hand audio terminal 286 and the main ground 295. Further, the switch 290 connects with the microphone terminal 282 via a signal line. For example, when a voltage outputted through the microphone terminal 282 is not smaller than a designated reference voltage, the switch 290 may connect the main ground 295 of the electronic device 280 with the right-hand audio terminal 286, and when the voltage outputted through the microphone terminal 282 is smaller than the designated reference voltage, the switch 290 may prevent the main ground 295 of the electronic device 280 from connecting with the right-hand audio terminal 286. The left-hand audio terminal 288 may output a left-hand audio signal from the electronic device 280 to the earset 200.

When the electronic device connector 220 of the above-described earset 200 is plugged into the ear jack 281 of the electronic device 280 to connect the earset 200 with the electronic device 280, the microphone terminal 222 may typically be connected with the microphone terminal 282 of the electronic device 280, receive power from the electronic device 280 through the microphone terminal 222, and if a voice is entered through the microphone 271 of the earset 200, output a microphone signal to the electronic device 280. Further, the audio ground terminal 224 may connect with the audio ground terminal 284 of the electronic device 280, the right-hand speaker terminal 226 may connect with the right-hand audio terminal 286 of the electronic device 280, and the left-hand speaker terminal 228 may connect with the left-hand audio terminal 288 of the electronic device 280.

Figure 3:
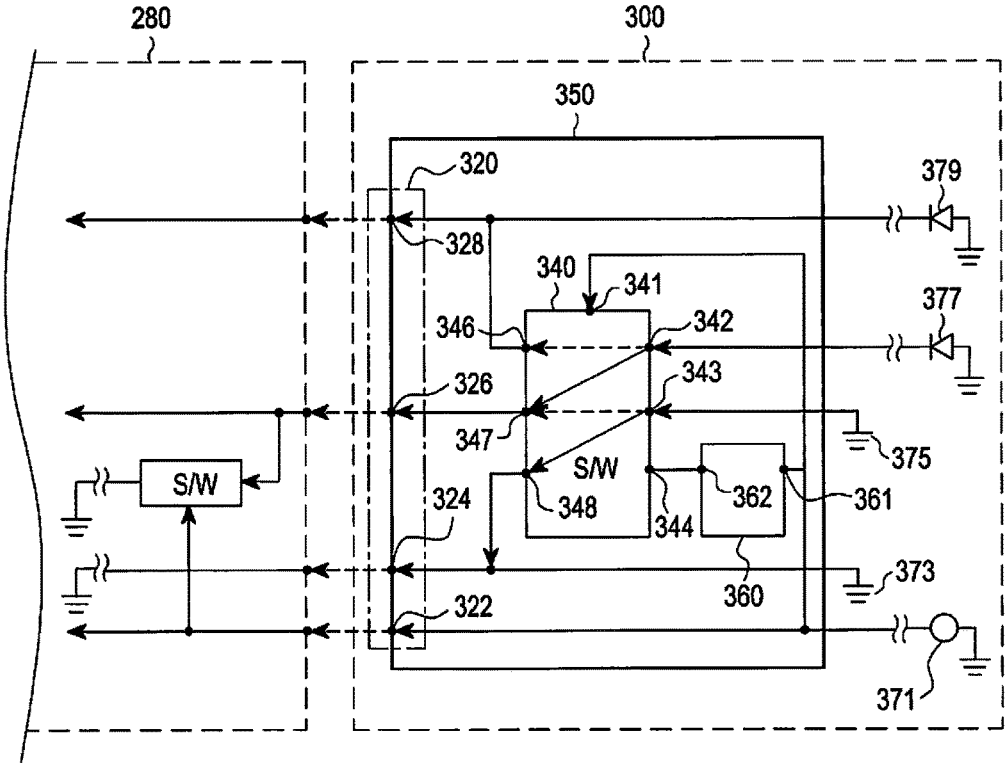
FIG. 3 is a circuit diagram illustrating an earset according to a second embodiment of the present invention.

FIG. 3 is a circuit diagram illustrating an earset device according to a second embodiment of the present invention. Referring to FIG. 3, an earset device 350 of an earset 300 may further include a voltage detector 360 typically used to check voltage, in addition to the configuration of FIG. 2. The voltage detector 360 may output a high or low signal as per a voltage at a microphone terminal 322 and input the signal to a switch 340. For example, if the voltage at the microphone terminal 322 is lower than a designated reference voltage, the voltage detector 360 may output a low signal, and if the voltage at the microphone terminal 322 is not lower than the designated reference voltage, the voltage detector 360 may output a high signal. The high or low signal may be a switching control signal of a switch.

For example, as per the high or low signal of the voltage detector 360, the switch 340 may perform a switching operation allowing a right-hand speaker 377 to connect with a left-hand speaker terminal 328 and a shielding ground 375 to connect with a right-hand speaker terminal 326 or a switching operation allowing the right-hand speaker 377 to connect with the right-hand speaker terminal 326 and the shielding ground 375 to connect with an audio ground terminal 324.

The earset device 350 of the earset 300 may include an electronic device connector 320, the switch 340, and the voltage detector 360.

The electronic device connector 320 may include a microphone terminal 322, an audio ground terminal 324, a right-hand speaker terminal 326, and a left-hand speaker terminal 328.

The switch 340 may include a power input terminal 341, a first signal input terminal 342, a second signal input terminal 344, a third signal input terminal 344, a first signal output terminal 346, a second signal output terminal 347, and a third signal output terminal 348. The switch 340 may be an analog switch.

The voltage detector 360 may include a voltage detector input terminal 361 and a voltage detector output terminal 362.

The microphone terminal 322 may be configured to connect with the power input terminal 341 of the switch 340 and the microphone 371 of the earset 300 via signal lines. Further, the audio ground terminal 324 may be configured to connect with the third signal output terminal 348 of the switch 340 via a signal line. Further, the right-hand speaker terminal 326 may be configured to connect with the second signal output terminal 347 of the switch 340 via a signal line. Further, the left-hand speaker terminal 328 may be configured to connect with the first signal output terminal 346 of the switch 340 and the left-hand speaker 379 of the earset 300 via signal lines.

The power input terminal 341 of the switch 340 may be configured to connect, via a signal line, with the signal line connecting the microphone terminal 322 with the microphone 271, and the first signal input terminal 342 may be configured to connect with the right-hand speaker 377 of the earset 300 via a signal line, and the second signal input terminal 343 may be configured to connect with the shielding ground 375 of the earset 300 via a signal line. Further, the third signal input terminal 344 of the switch 340 may be configured to connect with the voltage detector output terminal 363 via a signal line.

The voltage detector input terminal 361 of the voltage detector 360 may be configured to connect, via a signal line, with the signal line connecting the microphone terminal 322 with the power input terminal 341, and the voltage detector output terminal 362 may be configured to connect with the third signal input terminal 344 of the switch 340.

Further, as per an input voltage at the voltage detector input terminal 361 (as per a voltage at the microphone terminal 322), the voltage detector 360 may output a high or low signal through the voltage detector output terminal 362 and input the same to the third signal input terminal 344 of the switch 340. For example, if the voltage at the voltage detector input terminal 361 (the microphone terminal 322) is lower than a designated reference voltage, the voltage detector 360 may output a low signal, and if the voltage at the voltage detector input terminal 361 (the microphone terminal 322) is not lower than the designated reference voltage, the voltage detector 360 may output a high signal.

The switch 340 may receive power through the power input terminal 341. The switch 340 may, as per the high or low signal outputted from the voltage detector 360 and inputted through the third signal input terminal 344, switch to connect the first signal input terminal 342 of the switch 340 with the first signal output terminal 346 or the second signal output terminal 347 and to connect the second signal input terminal 343 of the switch 340 with the second signal output terminal 347 or the third signal output terminal 348.

For example, if receiving the low signal through the third signal input terminal 344, the switch 340 may switch to connect the first signal input terminal 342 with the second signal output terminal 347 and to connect the second signal input terminal 343 with the third signal output terminal 348. Further, for example, if receiving the high signal through the third signal input terminal 344, the switch 340 may switch to connect the first signal input terminal 342 with the first signal output terminal 346 and to connect the second signal input terminal 323 with the second signal output terminal 347.

The electronic device 280 of FIG. 3 may correspond to the electronic device 280 of FIG. 2. Hence, no further description is given of the electronic device 280 and connections between the electronic device 280 and the earset 300 that have been described above with reference to FIG. 2.

According to the above-described embodiments, if the earset 200 or 300 is connected with the electronic device 280, the earset 200 or 300 may receive power from the electronic device 280. Further, as per the power received, the switch 240 or 340 of the earset 200 or 300 may perform a switching operation allowing the right-hand speaker 277 or 377 and the left-hand speaker 279 or 379 of the earset 200 or 300 to jointly connect with one of the right-hand speaker terminal 226 or 326 and the left-hand speaker terminal 228 or 328 and the other of the right-hand speaker terminal 226 or 326 and the left-hand speaker terminal 228 or 328 to connect with the shielding ground 275 or 375 of the earset 200 or 300.

For example, in a case where the electronic device 280 is in a phone call mode when the earset 200 or 300 is connected with the electronic device 280, the earset 200 or 300 may receive power through the microphone terminal 222 or 322, and at this time, the power may remain, e.g., 2.8V.

Further, in a case where the electronic device 280 is in a normal mode, such as a MP3 mode or non-call mode when the earset 200 or 300 is connected with the electronic device 280, the earset 200 or 300 may receive power through the microphone terminal 222 or 322, and at this time, the power may remain, e.g., 1.8V.

Under the above voltage condition, if a reference voltage designated for the switch 240 or 340 is, e.g., 2.5V, when the earset 200 or 300 connects with the electronic device 280 and the electronic device 280 is in the phone call mode, a voltage at the microphone terminal 222 or 322 of the switch 240 or 340 becomes not lower than the designated reference voltage. Accordingly, the switch 240 or 340 may switch to connect the first signal input terminal 242 or 342 with the first signal output terminal 246 or 346 and to connect the second signal input terminal 243 or 343 with the second signal output terminal 247 or 347, so that the shielding ground 275 or 375 of the earset 200 or 300 may connect with the main ground 295 of the electronic device 280. Thus, a ground separation/mono mode (GND separation/MONO MODE) in which the shielding ground 275 or 375 and the audio ground 273 or 373 of the earset 200 or 300 may be separated from each other, and sounds are delivered through one channel (one speaker) may be achieved.

Under such voltage condition as in the above embodiment, if the reference voltage designated for the switch 240 or 340 is, e.g., 2.5V, when the earset 200 or 300 connects with the electronic device 280 and the electronic device 280 is in the normal mode (e.g., the MP3 mode or non-call mode), a voltage at the microphone terminal 222 or 322 of the switch 240 or 340 becomes lower than the designated reference voltage. Accordingly, the switch 240 or 340 may switch to connect the first signal input terminal 242 or 342 with the second signal output terminal 247 or 247 and to connect the second signal input terminal 243 or 343 with the third signal output terminal 248 or 348, so that the right-hand speaker 277 or 377 of the earset 200 or 300 may connect with the right-hand audio terminal 286 of the electronic device 280—at this time, the right-hand audio terminal 286 does not connect with the main ground 295. Thus, a GND non-separation/stereo mode in which sounds are delivered through two channels (left-hand and right-hand speakers 279 and 277 or 379 and 377 without the shielding ground 275 or 375 and the audio ground 273 or 373 being separated from each other, as in a conventional earset, may be achieved.

Figure 4:
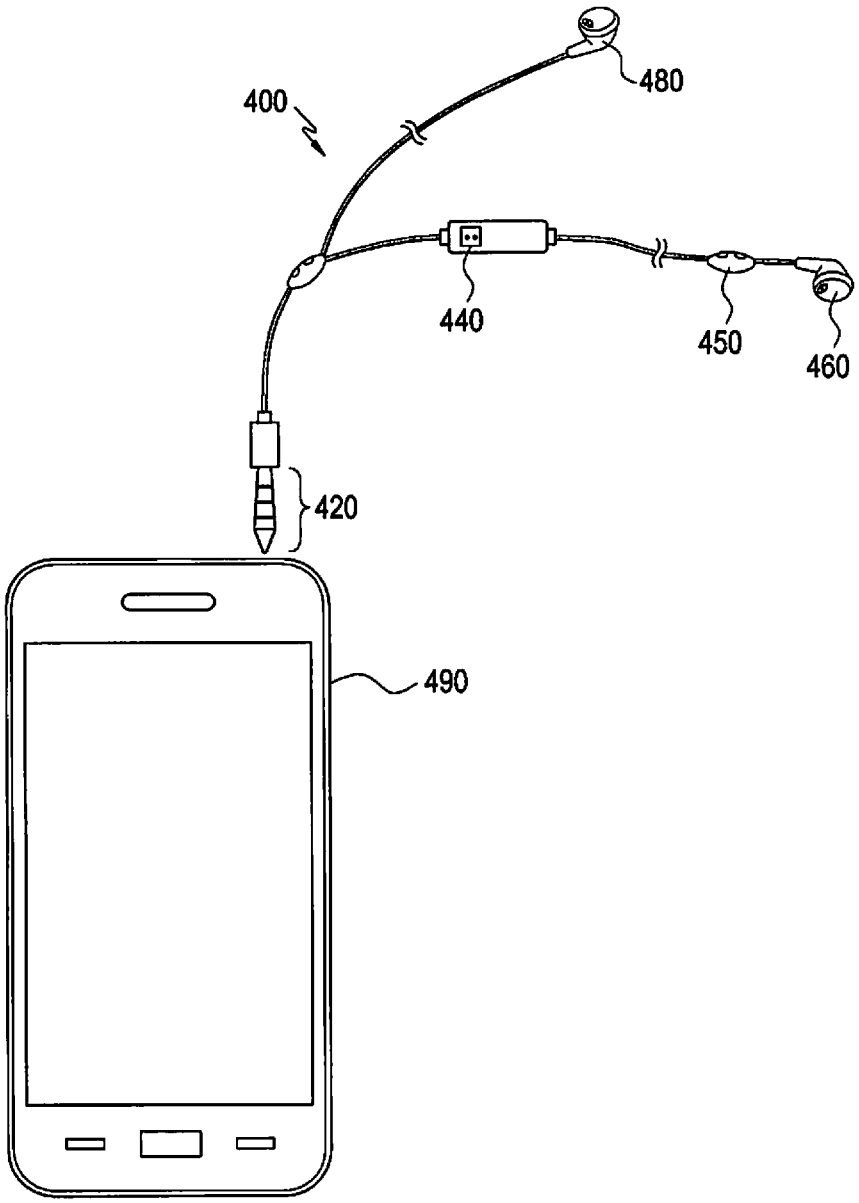
FIG. 4 is a view illustrating an outer look of an earset having two microphones, inserted into an electronic device according to an embodiment of the present invention.

By the earset device 250 or 350 of the earset 200 or 300, according to the above-described embodiments, when the earset 200 or 300 is connected to the electronic device 280 and is used to make a phone call (i.e., in the phone call mode), the shielding ground 275 or 375 of the earset may prevent RF noise. Further, when the earset 200 or 300 is connected to the electronic device 280, and the electronic device 280 is in the phone call mode, the shielding ground 275 or 375 of the earset 200 or 300 is separated from the audio ground 273 or 373, so that the total four audio signal terminals, i.e, the microphone 271 or 371, audio ground 273 or 373, right-hand speaker 277 or 377, and left-hand speaker 279 or 379, of the earset 200 or 300 may be shielded, blocking noise. FIG. 4 is a view illustrating an outer look of an earset having two microphones, inserted into an electronic device according to an embodiment of the present invention. Referring to FIG. 4, the earset 400 may include an electronic device connector 420, a first microphone 440, a second microphone 450, a right-hand speaker 460, and a left-hand speaker 480. Although not shown, the earset 400 may further include volume-up and volume-down buttons (not shown) for adjusting the volume of the electronic device. Further, the electronic device connector 420, one plugged into an earjack (not shown) of the electronic device 490, may connect the earset 400 with the electronic device 490.

Figure 5:
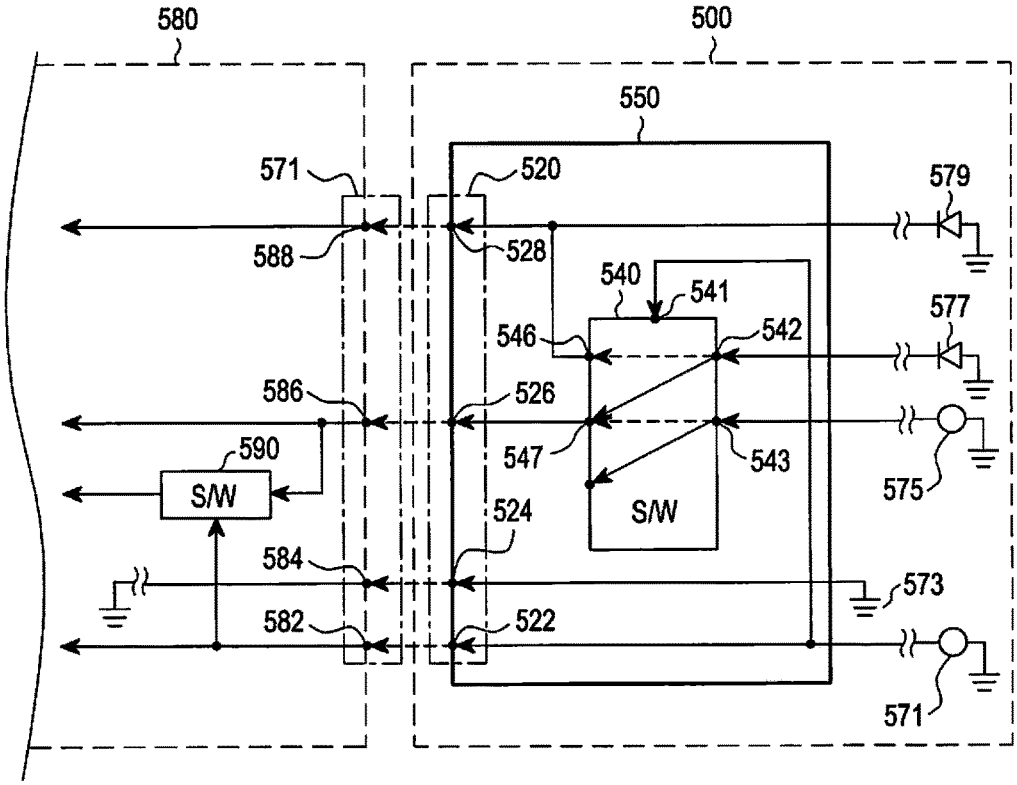
FIG. 5 is a circuit diagram illustrating an earset having two microphones according to the first embodiment of the present invention.

FIG. 5 is a circuit diagram illustrating an earset having two microphones according to the first embodiment of the present invention. Referring to FIG. 5, an earset 500 having two microphones includes a switch 540. According to a voltage inputted to a first microphone terminal 522, the switch 540 performs a switching operation allowing a right-hand speaker 577 and a left-hand speaker 579 of the earset 500 to be jointly connected with one of a right-hand speaker terminal 526 and a left-hand speaker terminal 528 or the other of the right-hand speaker terminal 226 and the left-hand speaker terminal 228 to be connected with a second microphone 575, so that the 2 MIC noise suppressor technique applied to conventional electronic devices may be implemented in the earset 500.

For example, if a voltage at the first microphone terminal 522 is not smaller than a designated reference voltage, the switch 540 performs a switching operation allowing the right-hand speaker 577 to connect with the left-hand speaker terminal 528 and the second microphone 575 to connect with the right-hand speaker terminal 526, so that the 2 MIC noise suppressor technique applied to conventional electronic devices may be implemented in the earset 500.

Further, if the voltage at the microphone terminal 522 is smaller than the designated reference voltage, the switch 540 performs a switching operation allowing the right-hand speaker 577 to connect with the right-hand speaker terminal 526 and the second microphone 575 to be opened, so that an implementation with a conventional earset 500 may be made possible.

Meanwhile, the left-hand speaker 579, the audio ground 573, and the first microphone 571 respectively connect with the left-hand speaker terminal 528, the audio ground terminal 524, and the first microphone terminal 522 as in conventional earsets.

Referring to FIG. 5, an earset device 550 of the earset 500 may include an electronic device connector 520 and the switch 540.

The electronic device connector 520 may include a first microphone terminal 522, an audio ground terminal 524, a right-hand speaker terminal 526, and a left-hand speaker terminal 528 of an earset having a typical structure.

The switch 540 may include a power input terminal 541, a first signal input terminal 542, a second signal input terminal 543, a first signal output terminal 546, and a second signal output terminal 547. The switch 540 may be an analog switch.

The first microphone terminal 522 may be configured to connect with the power input terminal 541 of the switch 540 and the first microphone 571 of the earset 500 via signal lines. Further, the right-hand speaker terminal 526 may be configured to connect with the second signal output terminal 547 of the switch 540 via a signal line. Further, the left-hand speaker terminal 528 may be configured to connect with the first signal output terminal 546 of the switch 540 and the left-hand speaker 579 of the earset 500 via signal lines.

The power input terminal 541 of the switch 540 may be configured to connect, via a signal line, with the signal line connecting the first microphone terminal 522 with the first microphone 571, and the first signal input terminal 542 may be configured to connect with the right-hand speaker 577 of the earset 500 via a signal line, and the second signal input terminal 543 may be configured to connect with the second microphone 575 of the earset 500 via a signal line.

Further, the switch 540 may receive power through the power input terminal 541. The switch 540 may, as per an input voltage at the power input terminal 541 (as per a voltage at the first microphone terminal 522), switch to connect the first signal input terminal 542 of the switch 540 with the first signal output terminal 546 or the second signal output terminal 547 and to connect the second signal input terminal 543 of the switch 540 with the second signal output terminal 547 or open the second signal input terminal 543.

For example, if the voltage at the power input terminal 541 (the first microphone terminal 522) is smaller than a designated reference voltage, the switch 540 may switch to connect the first signal input terminal 542 with the second signal output terminal 547 and to open the second signal input terminal 543. Further, for example, if the voltage at the power input terminal 541 (the first microphone terminal 522) is not smaller than the designated reference voltage, the switch 540 may switch to connect the first signal input terminal 542 with the first signal output terminal 546 and to connect the second signal input terminal 543 with the second signal output terminal 547.

Meanwhile, the electronic device 580 may include an earjack 581 of a typical structure. The earjack 581 may include a microphone terminal 582, an audio ground terminal 584, a right-hand audio terminal 586, and a left-hand audio terminal 588. Further, the microphone terminal 582, the audio ground terminal 584, the right-hand audio terminal 586, and the left-hand audio terminal 588 are configured to typcally connect with a codec (not shown) of the electronic device 580.

A structure of the electronic device 580 into which the earset 500 is plugged is described below in detail.

The microphone terminal 582 may be configured to connect with a power supply (not shown) of the electronic device 580 to supply power to the earset 500 and may receive a first microphone signal from the first microphone 571 of the earset 500. The right-hand audio terminal 586 may output a right-hand audio signal from the electronic device 580 to the earset 500. Further, the right-hand audio terminal 586 may allow or prevent a second microphone signal to/from being received as per a switching operation of a switch 590 of the electronic device 580. The switch 590 may connect in series between the right-hand audio terminal 586 and a codec (not shown). Further, the switch 590 connects with the microphone terminal 582. For example, when a voltage outputted through the microphone terminal 582 is not smaller than a designated reference voltage, the switch 590 may allow for a connection between a second microphone signal input terminal (not shown) of the codec (not shown) and the right-hand audio terminal 586, and when the voltage outputted through the microphone terminal 582 is smaller than the to designated reference voltage, the switch 590 may prevent the second microphone signal input terminal of the codec (not shown) from connecting with the right-hand audio terminal 586. The left-hand audio terminal 588 may output a left-hand audio signal from the electronic device 580 to the earset 500.

When the electronic device connector 520 of the above-described earset 500 is plugged into the earjack 581 of the electronic device 580 to connect the earset 500 with the electronic device 580, the first microphone terminal 522 may typically be connected with the microphone terminal 582 of the electronic device 580, receive power from the electronic device 580 through the first microphone terminal 522, and if a voice is entered through the microphone 571 of the earset 500, output a microphone signal to the electronic device 580. Further, the audio ground terminal 524 may connect with the audio ground terminal 584 of the electronic device 580, the right-hand speaker terminal 526 may connect with the right-hand audio terminal 586 of the electronic device 580, and the left-hand speaker terminal 528 may connect with the left-hand audio terminal 588 of the electronic device 580.

Figure 6:
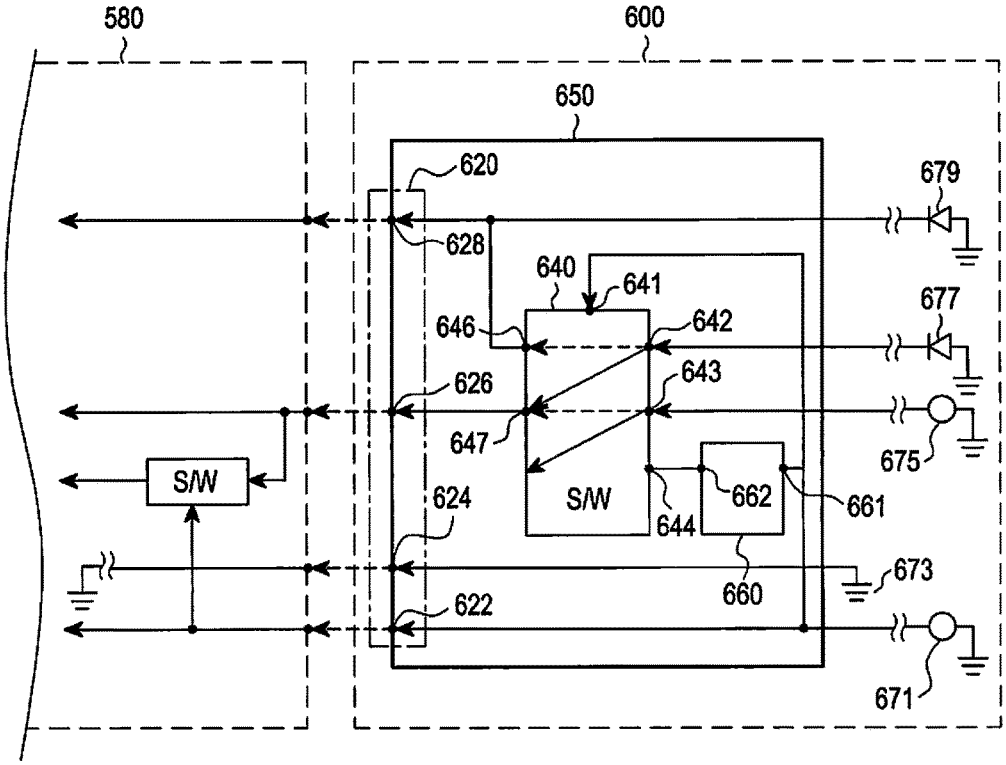
FIG. 6 is a circuit diagram illustrating an earset having two microphones according to the second embodiment of the present invention.

FIG. 6 is a circuit diagram illustrating an earset having two microphones according to the second embodiment of the present invention. Referring to FIG. 6, an earset device 650 of an earset 600 may further include a voltage detector 660 typically used to check voltage, in addition to the configuration of FIG. 5. The voltage detector 660 may output a high or low signal as per a voltage at a microphone terminal 622 and input the signal to a switch 640. For example, if the voltage at the microphone terminal 622 is lower than a designated reference voltage, the voltage detector 660 may output a low signal, and if the voltage at the microphone terminal 622 is not lower than the designated reference voltage, the voltage detector 360 may output a high signal. The high or low signal may be a switching control signal of the switch 640.

For example, as per the high or low signal of the voltage detector 660, the switch 640 may perform a switching operation allowing a right-hand speaker 677 to connect with a left-hand speaker terminal 628 and a second microphone 675 to connect with a right-hand speaker terminal 626, or the switch 640 may perform a switching operation allowing the right-hand speaker 677 to connect with the right-hand speaker terminal 626 and to open the second microphone 675.

Referring to FIG. 6, the earset device 650 of the earset 600 may include an electronic device connector 620, the switch 640, and the voltage detector 660.

The electronic device connector 620 may include a first microphone terminal 622, an audio ground terminal 624, a right-hand speaker terminal 626, and a left-hand speaker terminal 628.

The switch 640 may include a power input terminal 641, a first signal input terminal 642, a second signal input terminal 643, a third signal input terminal 644, a first signal output terminal 644, and a second signal output terminal 647. The switch 640 may be an analog switch.

The voltage detector 660 may include a voltage detector input terminal 661 and a voltage detector output terminal 662.

The first microphone terminal 622 may be configured to connect with the power input terminal 641 of the switch 640 and the first microphone 671 of the earset 600 via signal lines. Further, the right-hand speaker terminal 626 may be configured to connect with the second signal output terminal 647 of the switch 640 via a signal line. Further, the left-hand speaker terminal 628 may be configured to connect with the first signal output terminal 646 of the switch 640 and the left-hand speaker 679 of the earset 600 via signal lines.

The power input terminal 641 of the switch 640 may be configured to connect, via a signal line, with the signal line connecting the first microphone terminal 622 with the first microphone 671, and the first signal input terminal 642 may be configured to connect with the right-hand speaker 677 of the earset 600 via a signal line, and the second signal input terminal 643 may be configured to connect with the second microphone 675 of the earset 600 via a signal line. Further, the third signal input terminal 644 of the switch 640 may be configured to connect with the voltage detector output terminal 662 via a signal line.

The voltage detector input terminal 661 of the voltage detector 660 may be configured to connect, via a signal line, with the signal line connecting the first microphone terminal 622 with the power input terminal 641, and the voltage detector output terminal 662 may be configured to connect with the third signal input terminal 644 of the switch 640 via a signal line.

Further, as per an input voltage at the voltage detector input terminal 661 (as per a voltage at the first microphone terminal 622), the voltage detector 660 may output a high or low signal through the voltage detector output terminal 662 and input the same to the third signal input terminal 644 of the switch 640.

For example, if the voltage at the voltage detector input terminal 661 (the first microphone terminal 622) is lower than a designated reference voltage, the voltage detector 660 may output a low signal, and if the voltage at the voltage detector input terminal 661 (the first microphone terminal 622) is not lower than the designated reference voltage, the voltage detector 660 may output a high signal.

Further, the switch 640 may receive power through the power input terminal 641. The switch 640 may, as per the high or low signal outputted from the voltage detector output terminal 662 and inputted through the third signal input terminal 644, switch to connect the first signal input terminal 642 of the switch 640 with the first signal output terminal 646 or the second signal output terminal 647 and to connect the second signal input terminal 643 of the switch 640 with the second signal output terminal 647 or open the second signal input terminal 643.

For example, if receiving the low signal through the third signal input terminal 644, the switch 640 may switch to connect the first signal input terminal 642 with the second signal output terminal 647 and to open the second signal input terminal 643.

Further, for example, if receiving the high signal through the third signal input terminal 644, the switch 640 may switch to connect the first signal input terminal 642 with the first signal output terminal 646 and to connect the second signal input terminal 6433 with the second signal output terminal 647.

The electronic device 580 of FIG. 6 may correspond to the electronic device 580 of FIG. 5. Hence, no further description is given of the electronic device 580 and connections between the electronic device 580 and the earset 600 that have been described above with reference to FIG. 5.

According to the above-described embodiments, if the earset 500 or 600 is connected with the electronic device 580, the earset 500 or 600 may receive power from the electronic device 580. Further, as per the power received, the switch 540 or 640 of the earset 500 or 600 may perform a switching operation allowing the right-hand speaker 577 or 677 and the left-hand speaker 579 or 679 of the earset 500 or 600 to joinity connect with one of the right-hand speaker terminal 526 or 626 and the left-hand speaker terminal 528 or 628 and the other of the right-hand speaker terminal 526 or 626 and the left-hand speaker terminal 528 or 628 to connect with the second microphone 575 or 675 of the earset 500 or 600.

For example, in a case where the electronic device 580 is in a phone call mode when the earset 500 or 600 is connected with the electronic device 580, the earset 500 or 600 may receive power through the first microphone terminal 522 or 622, and at this time, the power may remain, e.g., 2.8V. Further, in a case where the electronic device 580 is in a normal mode, such as a MP3 mode or non-call mode when the earset 500 or 600 is connected with the electronic device 580, the earset 500 or 600 may receive power through the first microphone terminal 522 or 622, and at this time, the power may remain, e.g., 1.8V.

Under the above voltage condition, if a reference voltage designated for the switch 540 or 640 is, e.g., 2.5V, when the earset 500 or 600 connects with the electronic device 580 and the electronic device 580 is in the phone call mode, a voltage at the first microphone terminal 522 or 622 of the switch 540 or 640 becomes not lower than the designated reference voltage. Accordingly, the switch 540 or 640 may switch to connect the first signal input terminal 542 or 642 with the first signal output terminal 546 or 646 and to connect the second signal input terminal 543 or 643 with the second signal output terminal 547 or 647, so that the second microphone 575 or 675 of the earset 500 or 600 may connect with the right-hand speaker terminal 526 or 626 and thus with a second microphone signal input terminal (not shown) of a codec (not shown). Therefore, when a phone call proceeds, a circuit operating the 2 MIC noise suppressor function which is applied to conventional electronic devices may also be implemented in the earset 500 or 600, and two-microphone/mono mode (2MIC/MONO MODE) may be achieved in which sounds are delivered through one channel (one speaker), and a noise-free, optimal call may be performed in the phone call mode of the electronic device 580 using the earset 500 or 600.

Under such voltage condition as in the above-described embodiment, if a reference voltage designated for the switch 540 or 640 is, e.g., 2.5V, when the earset 500 or 600 connects with the electronic device 580 and the electronic device 580 is in the normal mode, a voltage at the first microphone terminal 522 or 622 of the switch 540 or 640 becomes lower than the designated reference voltage. Accordingly, the switch 540 or 640 may switch to connect the first signal input terminal 542 or 642 with the second signal output terminal 547 or 647 and to open the second signal input terminal 543 or 643, allowing the right-hand speaker 577 or 677 of the earset 500 or 600 to connect with the right-hand audio terminal 586 of the electronic device 580—at this time, the right-hand audio terminal 586 does not connect with the main ground 295. Thus, the right-hand speaker 577 or 677 of the earset 500 or 600 may connect with a right-hand audio input terminal (not shown) of a codec (not shown), and one-microphone/stereo mode (1 MIC/Stereo Mode) may be achieved in which sounds are delivered through two channels (a left-hand and right-hand speaker 579 and 577 or 679 and 677).

Figure 7:
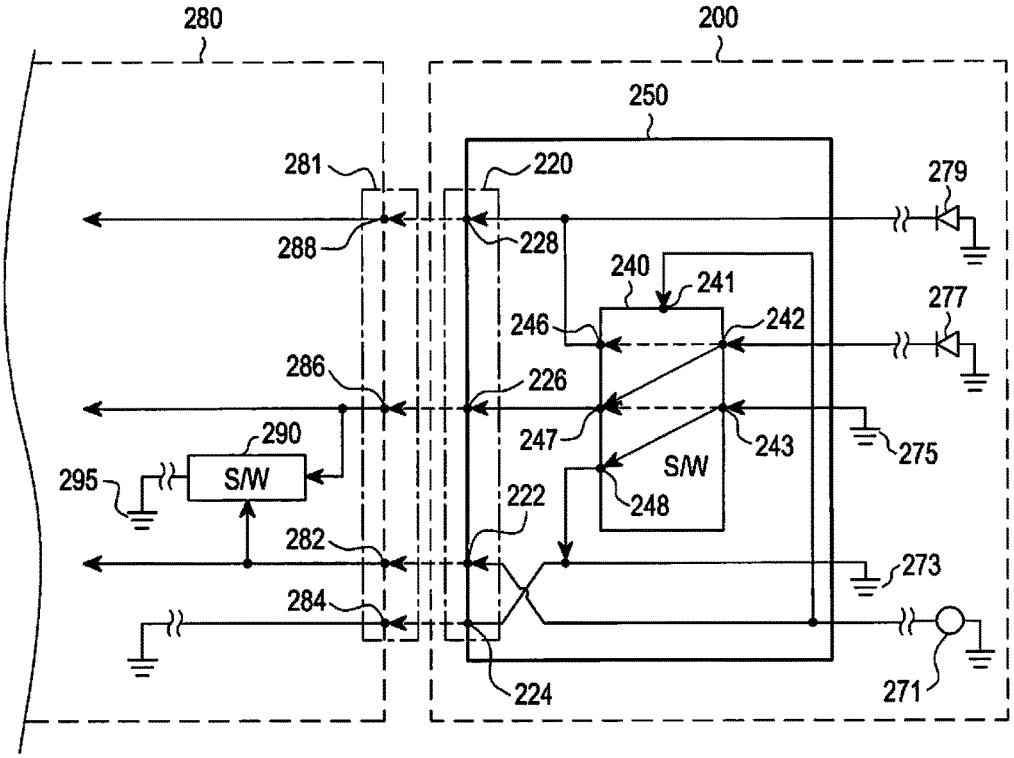
FIG. 7 is a circuit diagram illustrating an earset according to a third embodiment of the present invention.
Figure 8:
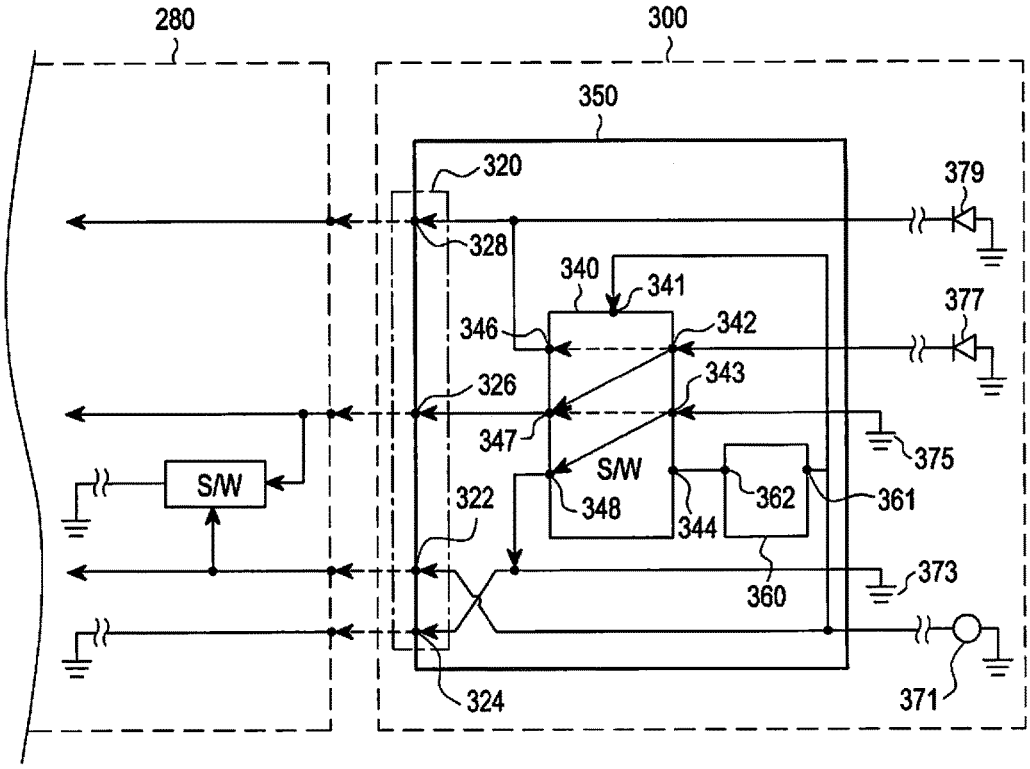
FIG. 8 is a circuit diagram illustrating an earset according to a fourth embodiment of the present invention.

FIG. 7 is a circuit diagram illustrating an earset device according to a third embodiment of the present invention, and FIG. 8 is a circuit diagram illustrating an earset device according to a fourth embodiment of the present invention. Referring to FIGS. 7 and 8, the configuration and connections of the earset 200 or 300 and the electronic device 280 or 380 shown in FIGS. 7 and 8 are the same as those shown in FIGS. 2 and 3, respectively. However, while FIGS. 2 and 3 illustrate an embodiment in which each terminal of the electronic device connector 220 or 320 is structurally positioned in the order of the left-hand speaker terminal 228 or 328, the right-hand speaker terminal 226 or 326, the audio ground terminal 224 or 324, and the first microphone terminal 222 or 322, FIGS. 7 and 8 illustrate an embodiment in which each terminal of the electronic device connector 220 or 320 is arranged in the order of the left-hand speaker terminal 228 or 328, the right-hand speaker terminal 226 or 326, the first microphone terminal 222 or 322, and the audio ground terminal 224 or 324.

Figure 9:
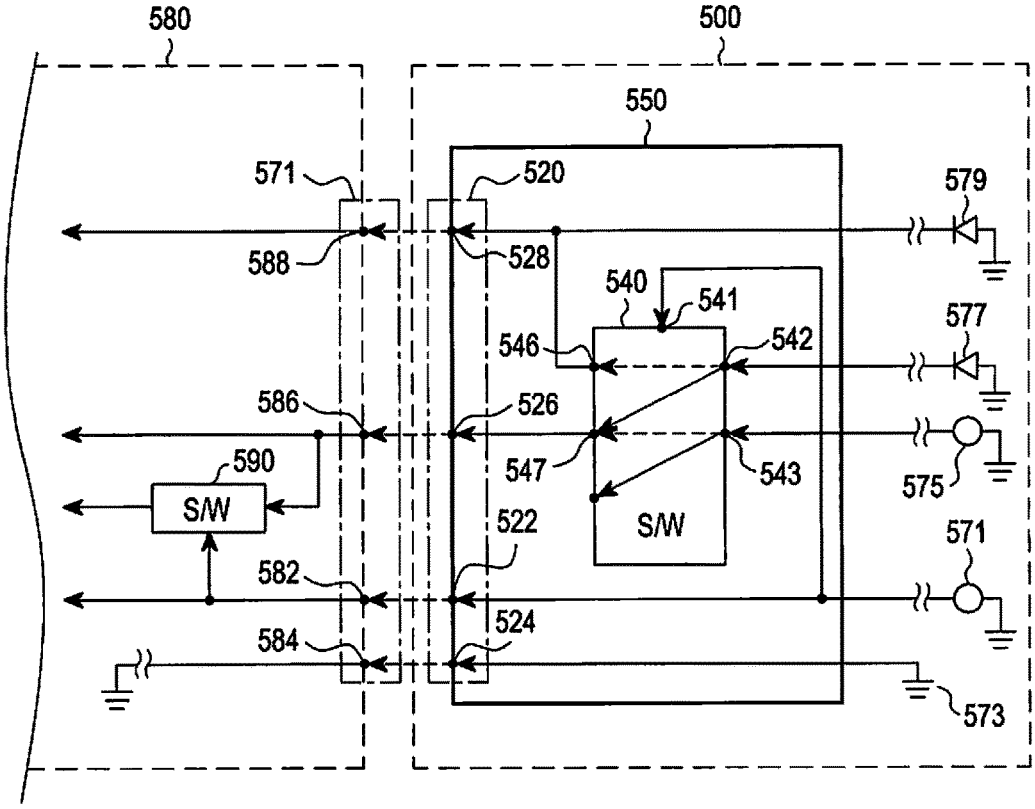
FIG. 9 is a circuit diagram illustrating an earset having two microphones according to the third embodiment of the present invention.
Figure 10:
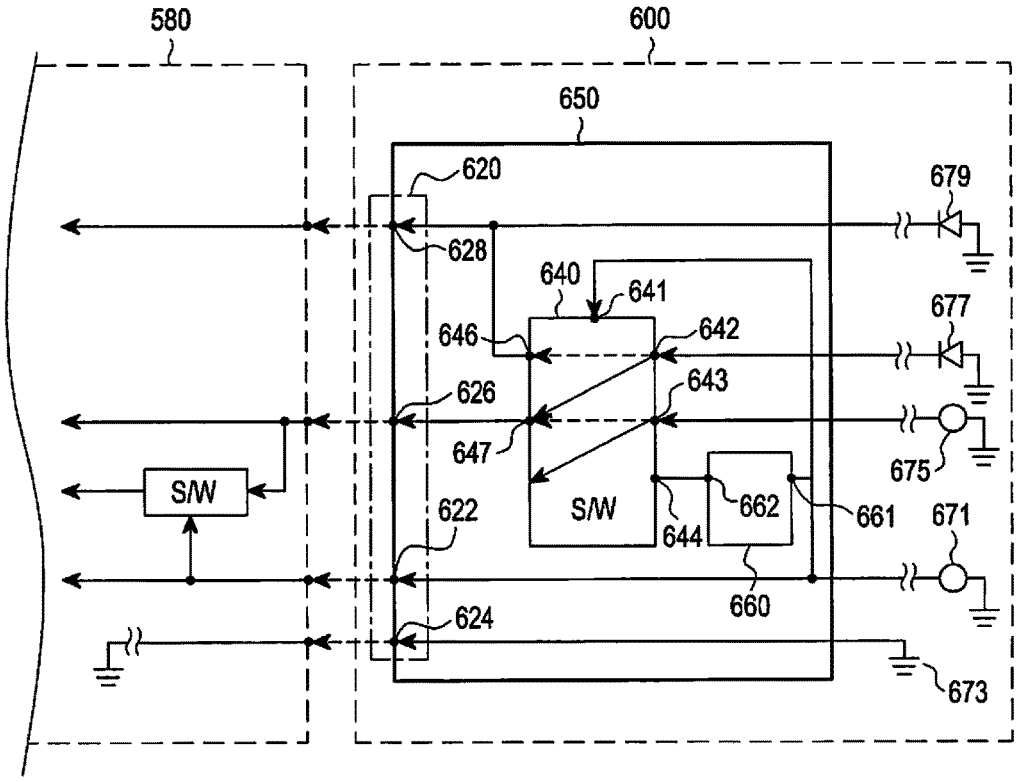
FIG. 10 is a circuit diagram illustrating an earset having two microphones according to the fourth embodiment of the present invention.
Figure 11:
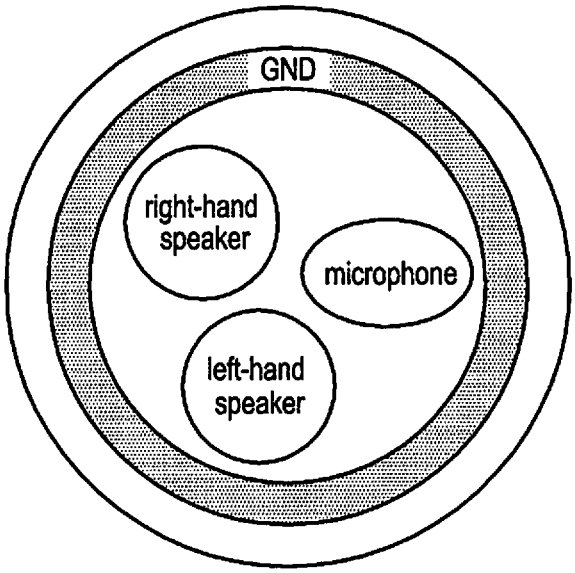
FIG. 11 is a cross-sectional view illustrating an earset according to the prior art.

FIG. 9 is a circuit diagram illustrating an earset device of an earset having two microphones according to the third embodiment of the present invention, and FIG. 10 is a circuit diagram illustrating an earset device of an earset having two microphones according to the fourth embodiment of the present invention. Referring to FIGS. 9 and 10, the configuration and connections of the earset 500 or 600 and the electronic device 580 or 680 shown in FIGS. 9 and 10 are the same as those shown in FIGS. 5 and 6, respectively. However, while FIGS. 5 and 6 illustrate an embodiment in which each terminal of the electronic device connector 520 or 620 is structurally positioned in the order of the left-hand speaker terminal 528 or 628, the right-hand speaker terminal 526 or 626, the audio ground terminal 524 or 624, and the first microphone terminal 522 or 622, FIGS. 9 and 10 illustrate an embodiment in which each terminal of the electronic device connector 520 or 620 is arranged in the order of the left-hand speaker terminal 528 or 628, the right-hand speaker terminal 526 or 626, the first microphone terminal 522 or 622, and the audio ground terminal 524 or 624.

Each of the aforementioned components of the earset, according to various embodiments of the present invention, may include one or more parts, and a name of the part may vary with a type of the earset. The earset in accordance with various embodiments of the present invention may include at lest one of the aforementioned components, omit some of them, or include other additional component(s). Some of the components of the earset may be combined together into an entity, but the entity may perform the same functions as those of the components before the components are combined. Further, according to various embodiments of the present invention, each component in the earset may be varied to have various positions.

The embodiments herein are provided merely for better understanding of the present invention, and the present invention should not be limited thereto or thereby. It should be appreciated by one of ordinary skill in the art that various changes in form or detail may be made to the embodiments without departing from the scope of the present invention defined by the following claims.

The invention claimed is:

1. An earset, comprising:

an electronic device connector including a microphone terminal connecting with a microphone of the earset, an audio ground terminal connecting with an audio ground of the earset, a right-hand speaker terminal, and a left-hand speaker terminal; and a switch allowing, according to a voltage at the microphone terminal, one of:

a) a right-hand speaker and a left-hand speaker of the earset to jointly connect with the right-hand speaker terminal and the left-hand speaker terminal to connect with a shielding ground of the earset, and b) the right-hand speaker and the left-hand speaker of the earset to jointly connect with the left-hand speaker terminal and the right-hand speaker terminal to connect with the shielding ground of the earset.

2. The earset of claim 1, wherein power is supplied from an electronic device through the microphone terminal.

3. The earset of claim 1, wherein the left-hand speaker connects with the left-hand speaker terminal, wherein the switch, when the voltage at the microphone terminal is not lower than a designated reference voltage, performs an operation allowing the right-hand speaker to connect with the left-hand speaker terminal and the shielding ground to connect with the right-hand speaker terminal, and when the voltage at the microphone terminal is lower than the designated reference voltage, performs an operation allowing the right-hand speaker to connect with the right-hand speaker terminal and the shielding ground to connect with the audio ground terminal.

4. The earset of claim 3, further comprising a voltage detector outputting a high or low signal as per the voltage at the microphone terminal, wherein the switch receives the high or low signal from the voltage detector, as per the received high or low signal, performs an operation allowing the right-hand speaker to connect with the left-hand speaker terminal and the shielding ground to connect with the right-hand speaker terminal or performs an operation allowing the right-hand speaker to connect with the right-hand speaker terminal and the shielding ground to connect with the audio ground terminal.

5. The earset of claim 1, wherein the left-hand speaker connects with the left-hand speaker terminal, wherein the switch includes a power input terminal connecting with the microphone, a first signal input terminal connecting with the right-hand speaker, a second signal input terminal connecting with the shielding ground, a first signal output terminal connecting with the left-hand speaker terminal, a second signal output terminal connecting with the right-hand speaker terminal, and a third signal output terminal connecting with the audio ground terminal, and wherein the switch, as per the voltage at the microphone terminal, switches to connect the first signal input terminal with the first signal output terminal or the second signal output terminal and to connect the second signal input terminal with the second signal output terminal or the third signal output terminal.

6. The earset of claim 5, further comprising a voltage detector having an input terminal connecting with the microphone terminal and an output terminal connecting with the third signal input terminal of the switch and outputting a high or low signal through the output terminal connecting with the third signal input terminal as per the voltage at the microphone terminal, wherein the switch receives the high or low signal, and as per the high or low signal, switches to connect the first signal input terminal with the first signal output terminal or the second signal output terminal and to connect the second signal input terminal with the second signal output terminal or the third signal output terminal.

7. An earset, comprising:

an electronic device connector including a first microphone terminal connecting with a first microphone of the earset, an audio ground terminal connecting with an audio ground of the earset, a right-hand speaker terminal, and a left-hand speaker terminal; and a switch allowing, according to a voltage at the microphone terminal, one of:

a) a right-hand speaker and a left-hand speaker of the earset to jointly connect the right-hand speaker terminal and the left-hand speaker terminal to connect with a second microphone of the earset, and b) the right-hand speaker and the left-hand speaker of the earset to jointly connect the left-hand speaker terminal and the right-hand speaker terminal to connect with the second microphone of the earset.

8. The earset of claim 7, wherein power is supplied from an electronic device through the first microphone terminal.

9. The earset of claim 7, wherein the left-hand speaker connects with the left-hand speaker terminal, wherein the switch, when the voltage at the first microphone terminal is not lower than a designated reference voltage, performs an operation allowing the right-hand speaker to connect with the left-hand speaker terminal and the second microphone to connect with the right-hand speaker terminal, and when the voltage at the first microphone terminal is lower than the designated reference voltage, allows the right-hand speaker to connect with the right-hand speaker terminal and the second microphone to be opened.

10. The earset of claim 9, further comprising a voltage detector outputting a high or low signal as per the voltage at the first microphone terminal, wherein the switch receives the high or low signal, and as per the received high or low signal, performs an operation allowing the right-hand speaker to connect with the left-hand speaker terminal and the second microphone to connect with the right-hand speaker terminal or performs an operation allowing the right-hand speaker to connect with the right-hand speaker terminal and the second microphone to be opened.

11. The earset of claim 7, wherein the left-hand speaker connects with the left-hand speaker terminal, wherein the switch includes a power input terminal connecting with the first microphone, a first signal input terminal connecting with the right-hand speaker, a second signal input terminal connecting with the second microphone, a first signal output terminal connecting with the left-hand speaker terminal, and a second signal output terminal connecting with the right-hand speaker terminal, and wherein the switch, as per the voltage at the first microphone terminal, switches to connect the first signal input terminal with the first signal output terminal or the second signal output terminal and to connect the second signal input terminal with the second signal output terminal or switch to allow the second signal input terminal to be opened.

12. The earset of claim 11, further comprising a voltage detector having an input terminal connecting with the first microphone terminal and an output terminal connecting with the third signal input terminal of the switch and outputting a high or low signal through the output terminal connecting with the second signal input terminal as per the voltage at the first microphone terminal, wherein the switch receives the high or low signal, and as per the high or low signal, switches to connect the first signal input terminal with the first signal output terminal or the second signal output terminal and to connect the second signal input terminal with the second signal output terminal or switch to allow the second signal input terminal to be opened.

13. A method for operating an earset having a microphone terminal, an audio ground terminal, a right-hand speaker terminal, and a left-hand speaker terminal, the method comprising:

an operation allowing the earset to receive power from an electronic device if the earset and the electronic device connect together; and a switching operation performed according to a voltage of the received power in which a switch of the earset allows one of:

a) a right-hand speaker and a left-hand speaker of the earset to jointly connect with the right-hand speaker terminal and the left-hand speaker terminal to connect with a shielding ground of the earset, and b) the right-hand speaker and the left-hand speaker of the earset to jointly connect with the left-hand speaker terminal and the right-hand speaker terminal to connect with the shielding ground of the earset.

14. The method of claim 13, wherein the left-hand speaker connects with the left-hand speaker terminal, wherein the switching operation includes, when the voltage is not lower than a designated reference voltage, enabling the switch to allow the right-hand speaker to connect with the left-hand speaker terminal and the shielding ground to connect with the right-hand speaker terminal, and when the voltage is lower than the designated reference voltage, enabling the switch to allow the right-hand speaker to connect with the right-hand speaker terminal and the shielding ground to connect with the audio ground terminal.

15. The method of claim 14, further comprising an operation allowing a voltage detector of the earset to input a high or low signal to the switch as per the voltage, wherein the switching operation includes enabling the switch to, as per the high or low signal, allow the right-hand speaker to connect with the left-hand speaker terminal and the shielding ground to connect with the right-hand speaker terminal or allow the right-hand speaker to connect with the right-hand speaker terminal and the shielding ground to connect with the audio ground terminal.

16. A method for operating an earset having a first microphone, a second microphone, a microphone terminal, an audio ground terminal, a right-hand speaker terminal, and a left-hand speaker terminal, the first microphone connecting with the microphone terminal, the method comprising:

an operation allowing the earset to receive power from an electronic device if the earset and the electronic device connect together; and a switching operation, according to a voltage of the received power in which a switch of the earset allows one of:

a) a right-hand speaker and a left-hand speaker of the earset to jointly connect with the right-hand speaker terminal and the left-hand speaker terminal to connect with the second microphone, and b) the right-hand speaker and the left-hand speaker of the earset to jointly connect the left-hand speaker terminal and the right-hand speaker terminal to connect with the second microphone.

17. The method of claim 16, wherein the left-hand speaker connects with the left-hand speaker terminal, wherein the switching operation includes, when the voltage is not lower than a designated reference voltage, enabling the switch to allow the right-hand speaker to connect with the left-hand speaker terminal and the second microphone to connect with the right-hand speaker terminal, and when the voltage is lower than the designated reference voltage, enabling the switch to allow the right-hand speaker to connect with the right-hand speaker terminal and the second microphone to be opened.

18. The method of claim 17, further comprising an operation allowing a voltage detector of the earset to input a high or low signal to the switch as per the voltage, wherein the switching operation includes enabling the switch to, as per the high or low signal, allow the right-hand speaker to connect with the left-hand speaker terminal and the second microphone to connect with the right-hand speaker terminal or allow the right-hand speaker to connect with the right-hand speaker terminal and the second microphone terminal to be opened.

* * * * *